United States Patent [19]

Mannato

[11] Patent Number: 4,843,681

[45] Date of Patent: Jul. 4, 1989

[54] SPRING LOADED HINGE

[75] Inventor: Pietro Mannato, Bologna, Italy

[73] Assignee: Finduck S.r.L., Bologna, Italy

[21] Appl. No.: 215,980

[22] Filed: Jul. 7, 1988

[30] Foreign Application Priority Data

Jul. 8, 1987 [IT] Italy ..... 15202/87[U]

[51] Int. Cl.[4] ..... E05D 5/12

[52] U.S. Cl. ..... 16/380; 16/304; 16/386; 150/118

[58] Field of Search ..... 16/304, 305, 308, 380, 16/381, 386; 150/118, 119, 146

[56] References Cited

U.S. PATENT DOCUMENTS

| | | | |
|---|---|---|---|
| 741,626 | 10/1903 | Chesney | 16/304 |
| 2,158,548 | 5/1939 | Lemire et al. | 16/304 X |
| 2,719,557 | 10/1955 | Bell | 150/146 X |
| 2,967,325 | 1/1961 | Herzfeld | 16/386 |
| 4,573,239 | 3/1986 | Valenti | 16/380 X |

FOREIGN PATENT DOCUMENTS

| | | | |
|---|---|---|---|
| 3607985 | 8/1987 | Fed. Rep. of Germany | 16/386 |

*Primary Examiner*—Fred A. Silverberg

*Attorney, Agent, or Firm*—Pollock, Vande Sande & Priddy

[57] ABSTRACT

Hinge particularly adapted for wallets, purses, paper-holders, or the like, consisting of two hinge members (1, 2) which are made of leather or similar flexible material, and which along one edge thereof are each provided with a row of comb-like, spaced apart co-axial tubular segments (3, 3'), the tubular segments (3) in one hinge member (1) being fitted between the tubular segments (3') in the other hinge member (2). A hinge pin (4) passed through the tubular segments (3, 3') in the two hinge members (1, 2) is in the form of a cylindrical helical spring (4) which is held in place by holding pins (5, 5') fitted in the ends of the helical spring (4) and provided with enlarged outward heads (205).

6 Claims, 1 Drawing Sheet

SPRING LOADED HINGE

FIELD OF THE INVENTION

The invention relates to a hinge, particularly adapted for wallets, purses, paper-holders, or the like, consisting of two hinge members which are made of leather or similar flexible material,and which along one edge thereof are each provided with a row of comb-like, spaced apart co-axial tubular segments, the tubular segments in one hinge member being fitted between the tubular segments in the other hinge member, and a hinge pin being passed through the tubular segments in the two hinge members.

SUMMARY OF THE INVENTION

The object of the invention is to provide a hinge of the aforementioned type, having a certain spring rate across the axis of its hinged connection, which can be manufactured in a low-cost simple manner, by using means readily available on the market, and which, despite its flexibility, has a high resistance to an alternating repetition of stress, and thus a long life. At the same time, the invention aims to make the assembly of the flexible hinge easy and quicker, and to render it possible as well to disassemble and re-assemble the said hinge.

This problem is solved by the invention by the feature that the hinge pin is in form of a cylindrical helical spring which is held in place by holding pins fitted in the ends of the helical spring and provided with enlarged outward heads.

Preferably, in order to cause the tubular segments in the hinge members to be best pivoted about the flexible hinge pin consisting of the helical spring, the turns of the cylindrical helical spring arranged in mutual contact.

In order to further facilitate the assembly of the holding pins to be threaded into the ends of the helical spring, each holding pin has at least one small annular projection which is fitted between two turns of the helical spring.

Preferably, the diameter of each of the holding pins is substantially the same as, or slightly greater than the insider diameter of the helical spring, so that the holding pins bear against the internal surface of the helical spring, and provide desirable rigidity to the end portions thereof.

The annular projection in each holding pin is preferably provided adjacent the enlarged outward head thereof, so as to prevent the pin from hopping when it is threaded through a large number of turns of the helical spring, before the annular projection being fitted between two of these turns.

In a preferred embodiment, the annular projection in each holding pin has a saw-tooth profile in axial section, with an inclined side directed inwardly, and with its steeper or axially perpendicular side directed outwardly. Thus, the insertion of the holding pin is facilitated, while the disengagement of the pin is made more difficult and requires a greater effort.

To further facilitate the engagement of the holding pins, each holding pin preferably has a rounded inward end. The enlarged outward head of each holding pin preferably has a convex, rounded shape, to prevent injury to the user.

BRIEF DESCRIPTION OF THE DRAWINGS

An embodiment of the flexible hinge according to the invention will be now described with reference to the accompanying drawing, in which.

DESCRIPTION OF THE PREFERRED EMBODIMENTS

The invention relates to a cylindrical hinge, in which the two hinge members 1 and 2 consist of strips of leather or of similar flexible material, which, by means of a cutting operation, are provided with mutually aligned, square or rectangular openings. The strips are then folded along their center line so as to form tubular rings 3,3', which can be comb-like inserted into one another, to compose a single tubular element shown in FIGS. 1 and 3. The flaps 101 and 102 of the two hinge members 1 and 2 are thus formed by superposed portions of the leather strips from which these flaps have been made, and the said flaps 101,102 may be attached by sewing or by means of any suitable technique to two members, which must be hingedly connected together, of a wallet or a paper-holder P shown by way of example in FIG. 1.

Since a purse or wallet must be held in a pocket and must be flexible and soft, provisions are made for the cylindrical hinge according to the invention to also have this feature of flexibility and, to this end, the hinge pin around which the hinge rings are turned, is formed by a cylindrical helical spring 4 of steel, with its turns in mutual contact, and of such a diameter and such a length, that this spring 4 can be received with very limited play in the tubular body formed by the assembly of the tubular rings 3,3'.

Figure 1:
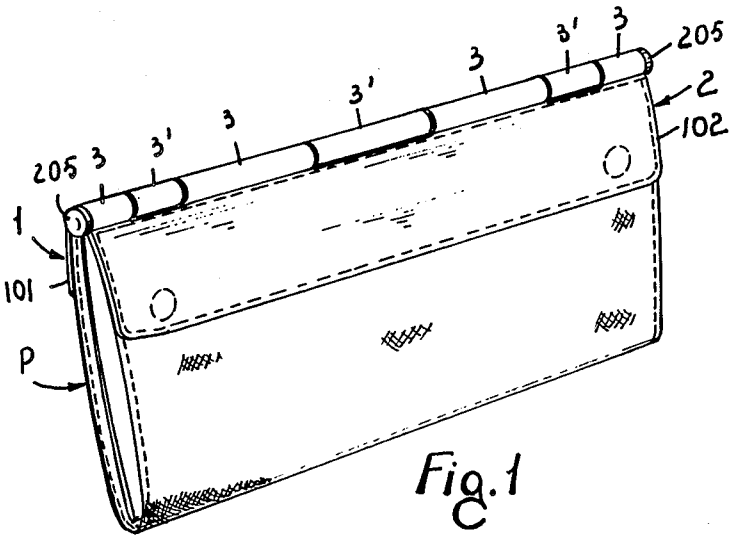
FIG. 1 is a perspective view of a wallet provided with a flexible hinge according to the invention.
Figure 2:
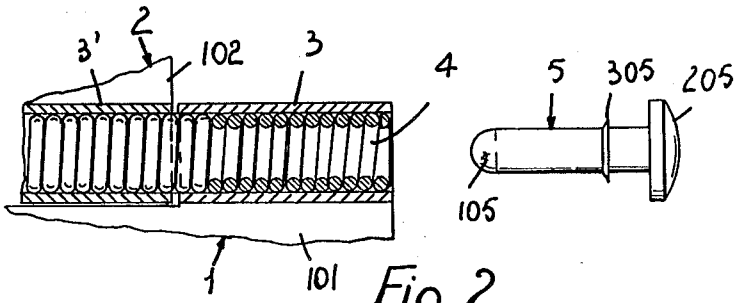
FIG. 2 is a view in longitudinal section of one of the ends of the helical spring used in the flexible hinge, the said spring being shown disconnected from one of the holding pins axially locking the same.
Figure 3:
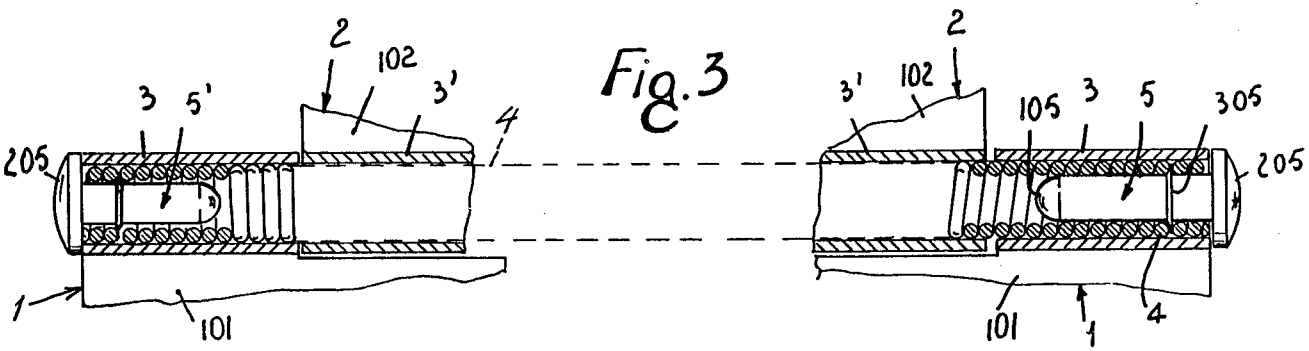
FIG. 3 is a view of the hinge with parts in longitudinal section and with the holding pins fitted in the ends of the helical spring.

In order to axially lock the spring 4 in position, holding pins 5,5' are pressure inserted into the ends of said spring, and these pins have a rounded inward end 105 for facilitating their insertion into the spring, while at their opposite end the said pins are provided with a preferably convex head 205 having substantially the same diameter as the outside diameter of the rings 3,3' against which abut the heads of said pins, as shown in FIGS. 1 and 3.

In the illustrated example, the holding pins 5,5' have a diameter which is substantially the same, or is slightly smaller than the inside diameter of spring 4, and the stem thereof is provided at a short distance from the head 205, with a small annular projection 305 having a substantially right-angled triangular cross-section, with its hypotenuse facing the inward end 105 of the holding pin, so that when this pin 5,5' is forced into the spring 4, the end turns of the spring will easily overstep the said projection which comes to be positioned between two consecutive turns, and which is prevented from being displaced in the opposite direction by its perpendicular side.

The fitting of the holding pins 5,5' into the ends of spring 4 may be effected by means other than those shown. For example, the holding pins 5,5' may have a diameter slightly greater than the inside diameter of the helical spring 4, and that their surface may be suitably roughened, so that they can be pressure inserted into the spring within which they will be held also owing to the pressure of such a roughening. According to a further modified embodiment, the holding pins 5,5' may have a small recessed portion in adjacent head 205, into which portion the final turns of the helical spring 4 will be elastically inserted. According to still another modified embodiment, the holding pins 5,5' may be threaded and may be inserted by screwing them into the spring ends.

I claim:

1. A hinge comprising (a) first and second hinge members (1, 2) each provided along one edge thereof with a plurality of spaced apart co-axial tubular segments (3, 3'), the tubular segments (3) of said first hinge member (1) being fitted between the tubular segments (3') of said second hinge member (2);

(b) a hinge pin (4) in the form of a cylindrical helical spring whose turns are in mutual contact being passed through said tubular segments (3, 3') of said first and second hinge members (1, 2);

(c) holding pins (5, 5') fitted in ends of said helical spring (4) and having enlarged outward heads (205) for retaining said spring in position within said tubular segments; and (d) at least one small annular projection (305) on each holding pin (5), said projection being fitted between consecutive turns of said helical spring (4), for preventing disengagement of said holding pin from said tubular segments.

2. The hinge according to claim 1, wherein the diameter of the holding pins (5) is substantially the same as, or slightly greater than, the inside diameter of the helical spring (4).

3. The hinge according to claim 2, wherein said at least one annular projection (305) is provided adjacent the enlarged outward head (205) of the respective holding pin (5).

4. The hinge according to claim 3, wherein said annular projection (305) in each holding pin (5) has a sawtooth profile in axial section, with an inclined side directed inwardly, and a substantially axially perpendicular side directed outwardly.

5. The hinge according to claim 4, wherein each holding pin (5) has a rounded inward end (105).

6. The hinge according to claim 5, wherein said outward head (205) of each holding pin (5) has a convex, rounded shape.

* * * * *